US007461459B2

(12) United States Patent
Lin

(10) Patent No.: US 7,461,459 B2
(45) Date of Patent: Dec. 9, 2008

(54) INSTRUMENT FOR DRAWING ELLIPSE OR THE LIKE

(76) Inventor: Yu-Hui Lin, 7F, No. 12, Lane 16, Shuanghe St., Yonghe City, Taipei County (TW)

( * ) Notice: Subject to any disclaimer, the term of this patent is extended or adjusted under 35 U.S.C. 154(b) by 30 days.

(21) Appl. No.: 11/652,887

(22) Filed: Jan. 12, 2007

(65) Prior Publication Data

US 2008/0168668 A1 Jul. 17, 2008

(51) Int. Cl.
*B43L 11/00* (2006.01)
*B43L 11/05* (2006.01)

(52) U.S. Cl. ..... 33/30.6; 33/27.03

(58) Field of Classification Search ..... 33/30.6, 33/30.1, 30.4, 30.7
See application file for complete search history.

(56) References Cited

U.S. PATENT DOCUMENTS 2,017,430 A * 10/1935 Anderson ..... 33/27.03
2,318,384 A * 5/1943 Fried ..... 33/27.02
3,264,736 A * 8/1966 Novak ..... 33/27.03
3,797,119 A * 3/1974 McDow ..... 33/27.09
3,820,244 A * 6/1974 Novak ..... 33/27.03
3,854,213 A * 12/1974 Armitt ..... 33/30.7
4,045,875 A * 9/1977 Cortez ..... 33/30.4
4,226,022 A * 10/1980 Chen et al. ..... 33/30.7
4,790,222 A * 12/1988 Morgan ..... 33/30.7
5,056,230 A * 10/1991 Lok ..... 33/30.1
5,189,800 A * 3/1993 Morita et al. ..... 33/30.1
6,308,426 B1 * 10/2001 Lim ..... 33/30.5

* cited by examiner

*Primary Examiner*—Christopher W Fulton

(57) ABSTRACT

A drawing instrument includes a turning assembly including a handle, a post having an end center, a bevel gear rotatable about the post, and a lower extending socket; a gear assembly meshed with the bevel gear and including a wheel; a link assembly including a first link having an upper end pivotably secured to the wheel, and a second link pivotably secured to a lower end of the first link and having a lower portion received in the socket; and a drawing assembly including an arm including a scale and a groove, a wheeled support secured to the arm, a third link pivotably secured to the second link and the groove, a slider pivotably secured to the third link and adapted to slide in the groove, and a pen mounting bed adjustably fastened at the groove. Rotating the handle will cause the pen mounting bed to draw an ellipse.

2 Claims, 10 Drawing Sheets

INSTRUMENT FOR DRAWING ELLIPSE OR THE LIKE

BACKGROUND OF THE INVENTION

1. Field of Invention

The invention relates to instruments for drawing an ellipse and more particularly to an improved instrument for drawing an ellipse or a closed line having three or more arcuate portions.

2. Description of Related Art

There have been numerous suggestions in prior patents for instruments for drawing an ellipse. For example, U.S. Pat. No. 4,182,043 ("the '043 patent") describes a drawing instrument for an ellipse. However, the '043 patent is limited in drawing different shapes of ellipse. Thus, continuing improvements in the exploitation of instrument for drawing ellipse or the like are constantly being sought.

SUMMARY OF THE INVENTION

It is therefore one object of the invention to provide a compass comprising an upright turning assembly including a top disc, a rotatable handle extending from the disc, a cylindrical post, an upper first bevel gear extending downward from the disc and adapted to rotate about an upper portion of the post, a pointed center at a bottom end of the post, a bar extending from a first position of the post proximate the center, and a socket at an open end of the bar; a gear assembly including a second bevel gear meshed with the first bevel gear, the second bevel gear adapted to rotate about a shaft having one end connected to a second position of the post below the first bevel gear, a gearwheel meshed with the second bevel gear and having a shaft having one end inserted through a third position of the post below the second position and adapted to rotate about the third position of the post, and a wheel secured to the other end the shaft of the gearwheel and including a plurality of holes arranged as an arc; a link assembly including a first link having an upper end pivotably secured to one of the holes, and a second link including an upper first section having an upper end pivotably secured to a lower end of the first link, and a lower second section adjustably secured to the first section and moveably received in the socket; and a drawing assembly including a horizontal arm having one end secured to a lower portion of the post, the arm including a scale and a lengthwise groove, a wheeled support at the other end of the arm, a third link having an upper end pivotably adjustably secured to the second section, and a lower end pivotably slidably fastened in the groove, a slider having one end secured to the lower end of the third link and the other end slidably fastened in the groove, the slider including a lengthwise trough, and a pen mounting bed including a fastener for adjustably securing the pen mounting bed to the groove and the trough, whereby positioning the center and continously rotating the handle in a first predetermined direction will turn the first bevel gear, the second bevel gear, the gearwheel, the wheel, and the upper end of the first link to move the second link up and down repeatedly and repeatedly slide the slider back and forth with the pen mounting bed traveling around the center until an ellipse is drawn.

The above and other objects, features and advantages of the invention will become apparent from the following detailed description taken with the accompanying drawings.

DETAILED DESCRIPTION OF THE INVENTION

Figure 1:
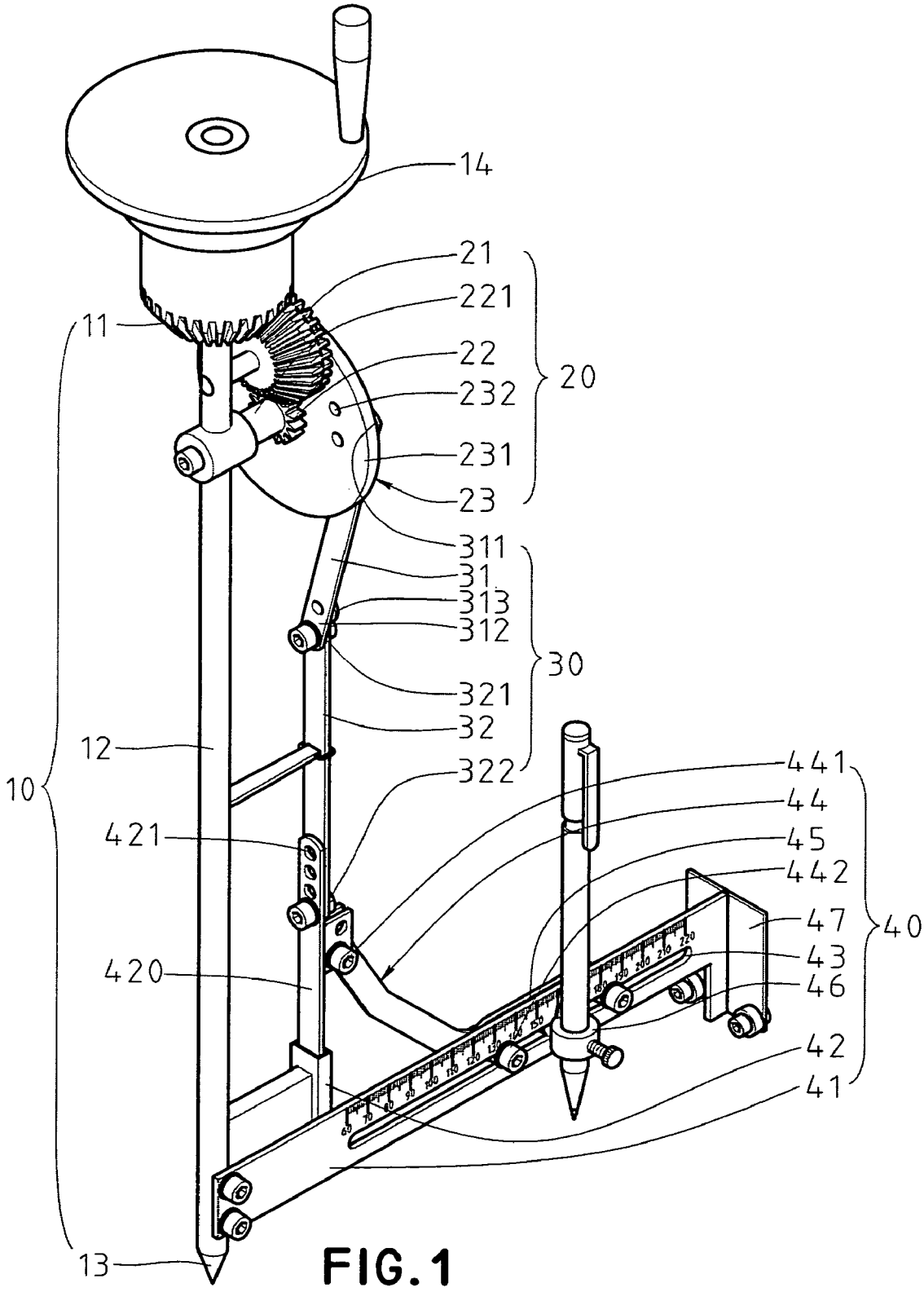
FIG. 1 is a perspective view of a preferred embodiment of drawing instrument according to the invention.
Figure 2:
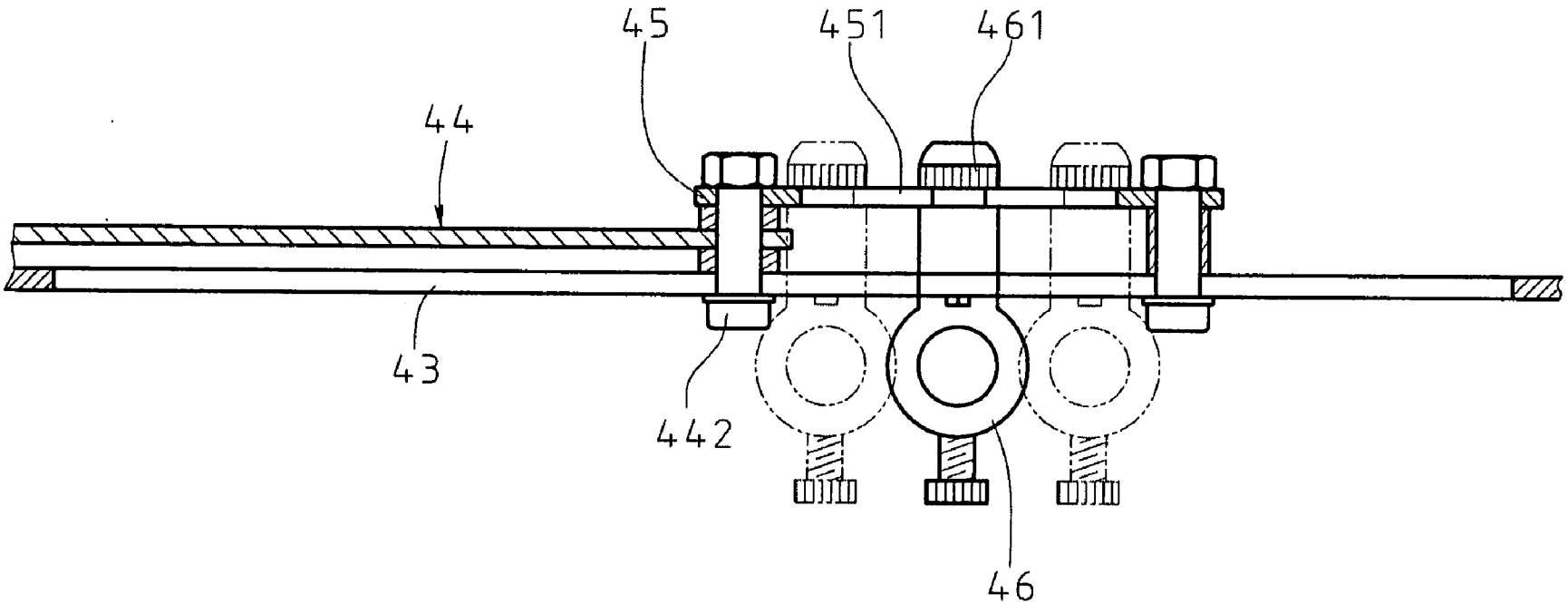
FIG. 2 is a top plan view in part section of arm, slider, and mounting bed for showing a horizontal adjustment of the slider.
Figure 3:
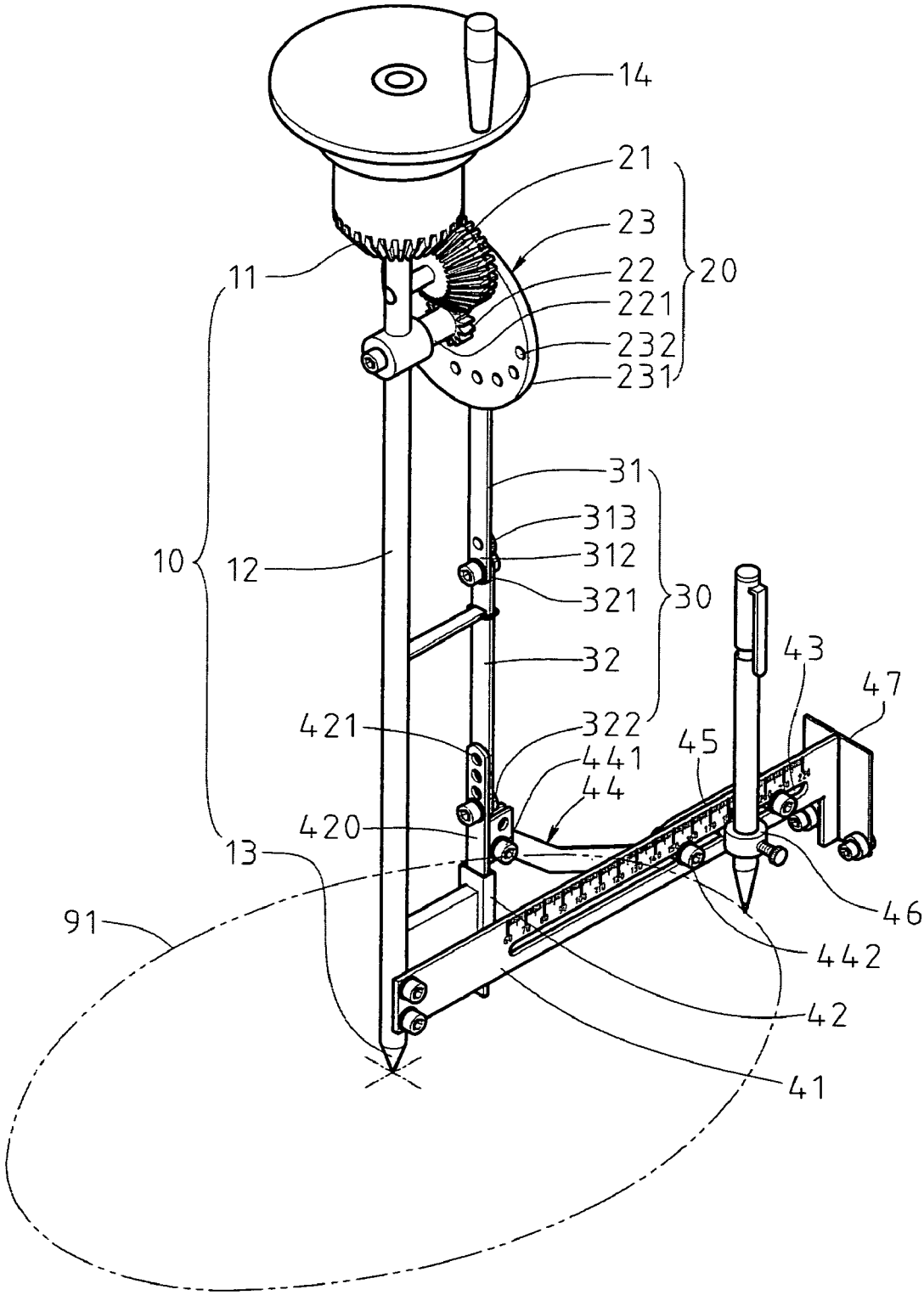
FIGS. 3 to 6 are perspective views of the instrument showing an ellipse being drawn.
Figure 4:
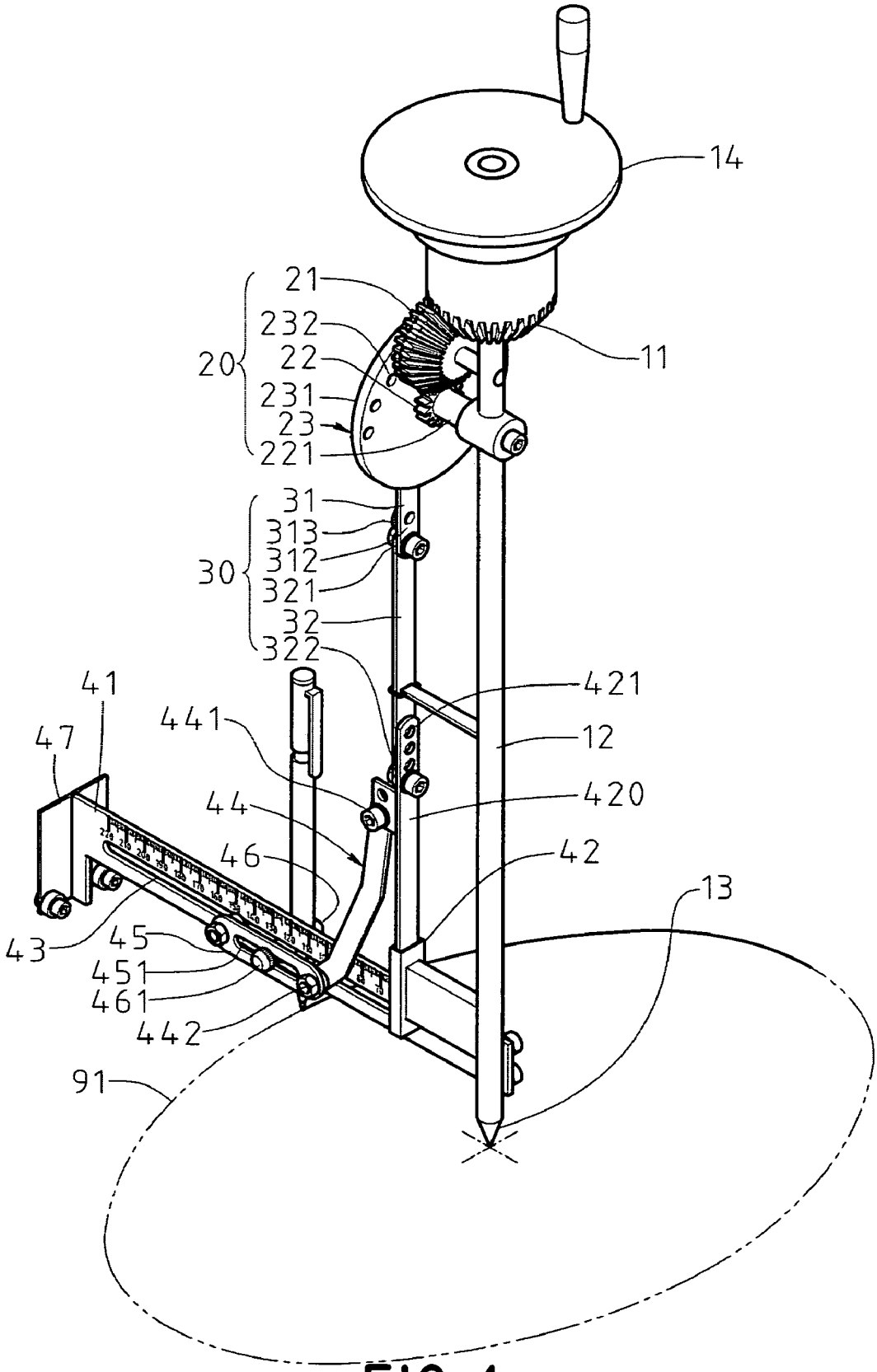
Figure 5:
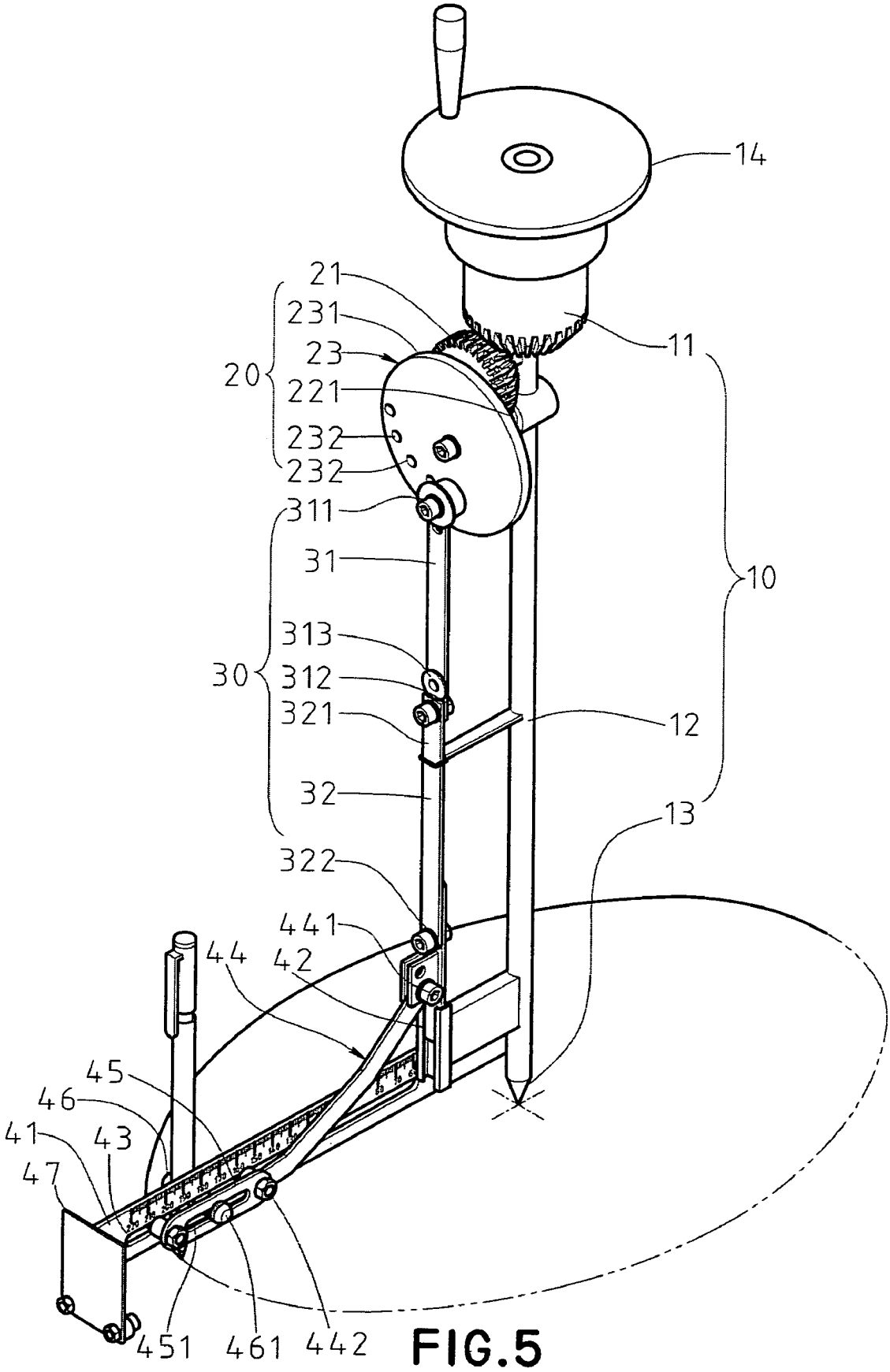
Figure 6:
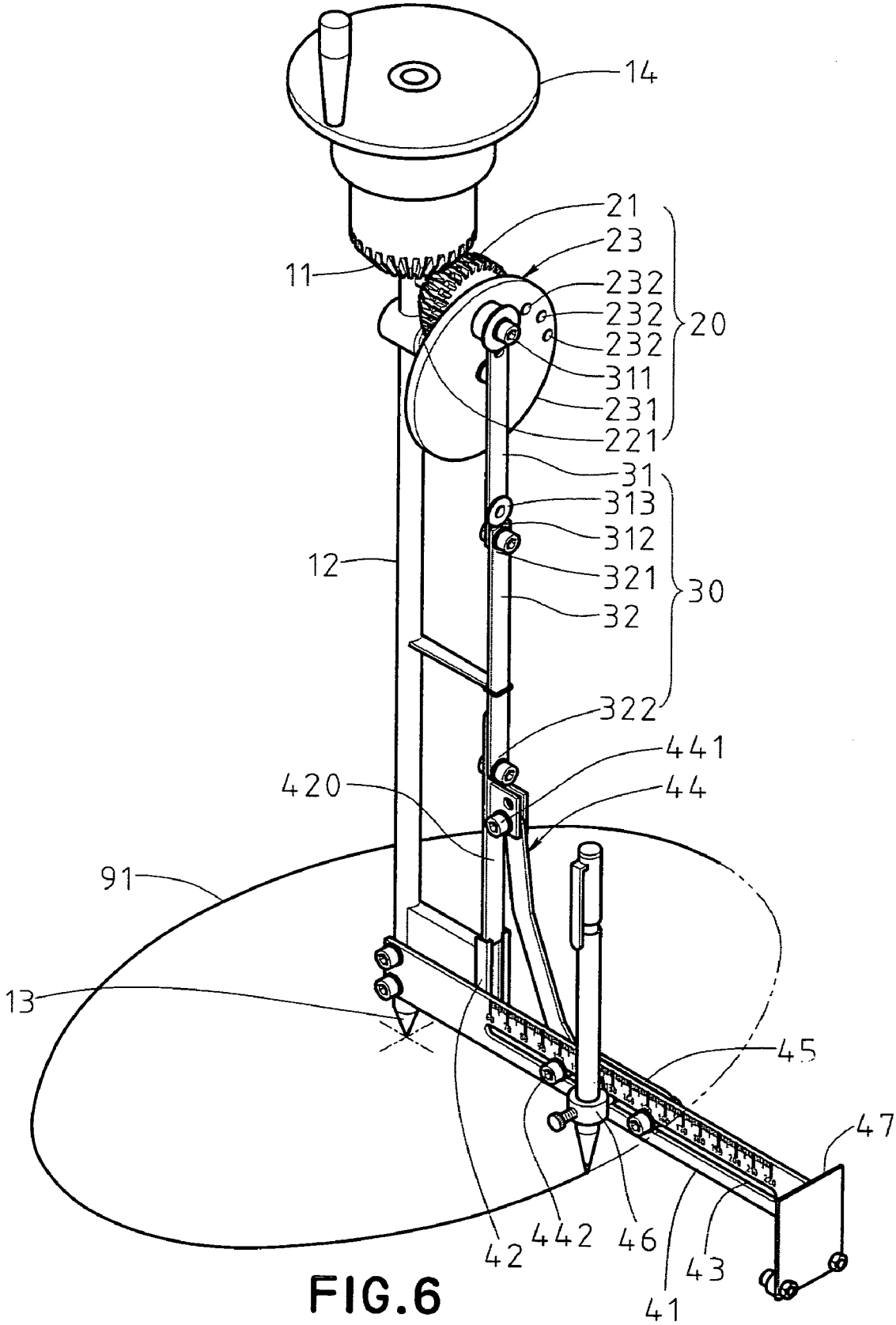
Figure 7:
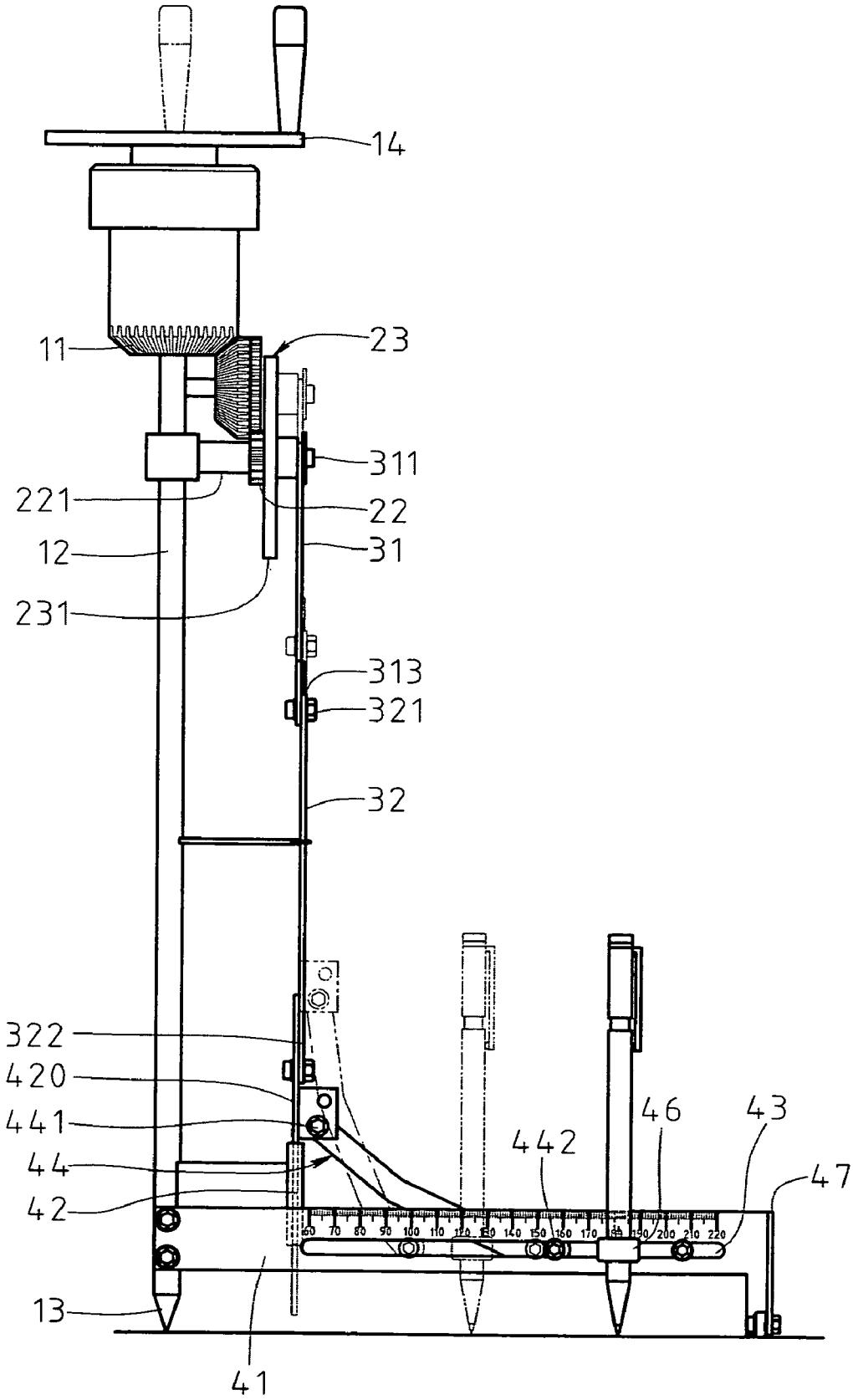
FIG. 7 is a side elevation of FIG. 1 showing a maximum distance of the mounting bed traveled as an upper end of the third link moves upward from a lower limit to an upper limit.
Figure 8:
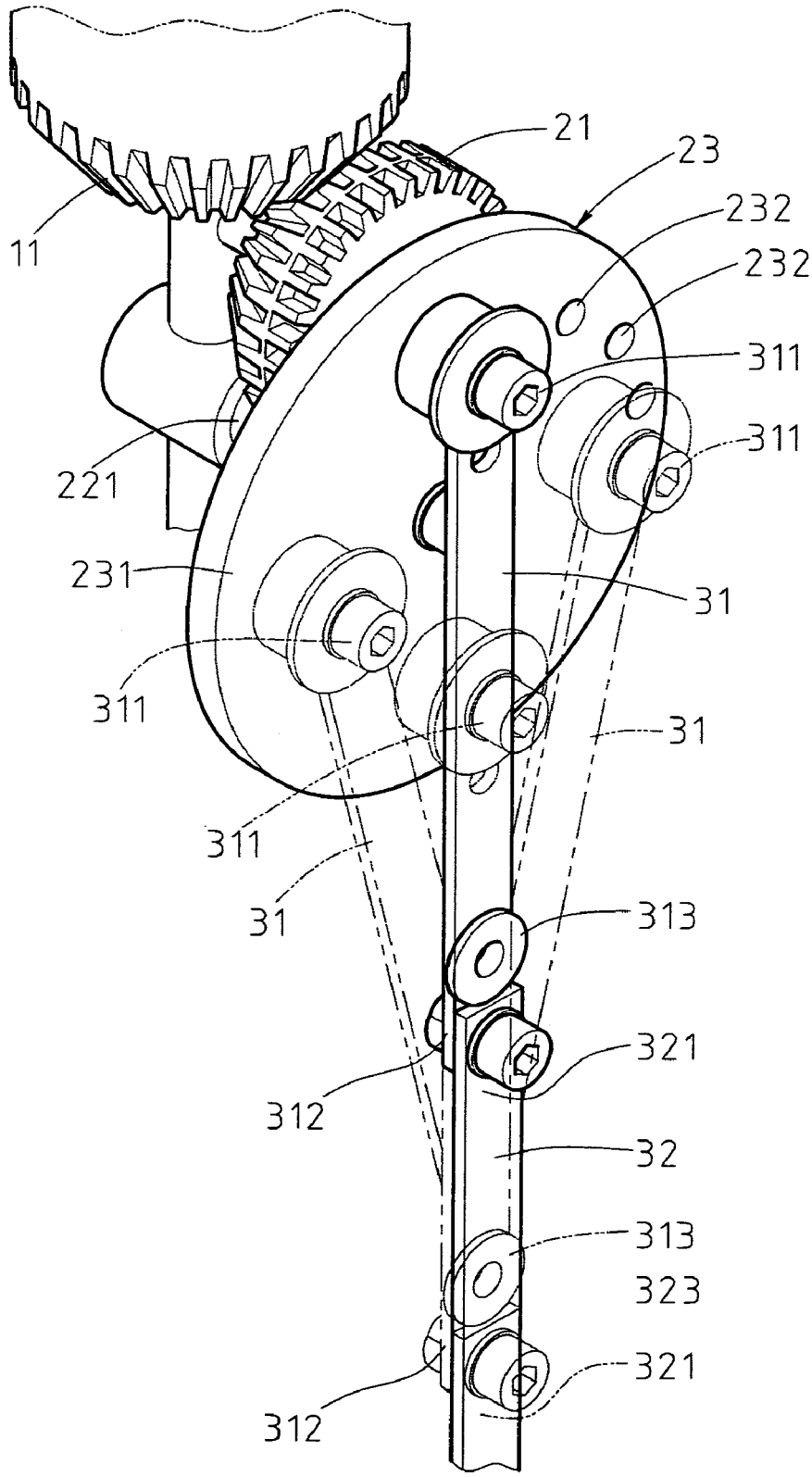
FIG. 8 is a perspective view of the gear assembly and associated components of the turning assembly and the link assembly for showing upward and downward movements of the second link in a drawing operation.

Referring to FIGS. 1 to 8, a manual drawing instrument in accordance with a preferred embodiment of the invention comprises the following components.

An upright turning assembly 10 comprises a rotatable handle (not numbered) extending upwardly from an edge of a top disc 14, an intermediate cylindrical post 12, an upper first bevel gear 11 extending downward from the disc 14 and adapted to rotate about an upper portion of the post 12, and a pointed center 13 formed at a bottom end of the post 12.

A gear assembly 20 comprises a second bevel gear 21 meshed with the first bevel gear 11, the second bevel gear 21 including a shaft having one end connected to and adapted to rotate about a first point of the post 12 below the first bevel gear 11, a gearwheel 22 meshed with the second bevel gear 21 and having a shaft 221 inserted through a second point of the post 12 below the first point and adapted to rotate about the second point of the post 12, and a wheel 23 secured to the other end of the shaft of the gearwheel 22 opposite the post 12 (i.e., the wheel 23 and the gearwheel 22 are co-rotated) and including a main disc 231 and a plurality of holes 232 arranged as an arc between a center of the main disc 231 and an edge thereof.

A link assembly 30 comprises a first link 31 having an upper end formed as a first joint 311 pivotably secured to one of the holes 232, a lower end 312 having a pivot hole, and a disc-shaped stop member 313 proximate the lower end 312; a second link 32 disposed below the wheel 23 by a predetermined distance and having an upper end formed as a second joint 321 pivotably secured to the hole of the lower end 312 of the first link 31, wherein the stop member 313 is adapted to define an angle from a position when the first link 31 travels to a leftmost point of the wheel 23 to a position when the first link 31 travels to a rightmost point of the wheel 23 (see FIG. 8), and a third joint 322 formed at a lower end. In operation, the second link 32 is adapted to move upward or downward only as detailed later. Further, the movement is maintained by a rectangular rigid loop (not numbered) horizontally extending from a position of the post 12 between the first bevel gear 11 and the point 13 with the second link 32 passing through.

A drawing assembly 40 comprises a lower socket 42 horizontally extending from a position of the post 12 proximate the point 13, and a guide member 420 of rectangular section having a lower portion vertically moveably disposed in the socket 42, and a plurality of vertically disposed holes 421 at an upper portion, wherein the third joint 322 is adjustably secured to one of the holes 421. The socket 42 together with the loop can define and maintain an upward or downward movement of the second link 32 in an operation as detailed later.

The drawing assembly 40 further comprises a rectangular, horizontal arm 41 having one end secured to a position of the post 12 slightly above the point 13, the arm 41 including a scale (not numbered) printed along either surface of an upper edge, an elongate groove 43 formed in the arm 41, the groove 43 having a length substantially the same as that of the scale, a rectangular support 47 formed at the other end of the arm 41, the support 47 having two rollers at two bottom corners being in rotatable contact with, for example, a desk, a third link 44 having an upper end 441 adjustably secured to the third joint 322 and a lower end 442 slidably fastened in the groove 43, an elongate slider 45 having one end secured to the lower end 442 which is slidable in the groove 43, and the other end secured to a pin (not numbered) which is also slidable in the groove 43, (i.e., the slider 45 is adapted to slide relative to the groove 43), the slider 45 including a lengthwise trough 451, and a mounting bed 46 for fastening a pencil, a pen (as shown), or a cutter depending on applications, the mounting bed 46 including a screw (e.g., thumb screw) 461 for securing the mounting bed 46 to the groove 43 and the trough 451 and securing the pen as shown to the mounting bed 46. Further, the thumb screw 461 is adapted to fasten or loosen for adjusting a fastened position the mounting bed 46 at the slider 45 (see FIG. 2). Note that it is possible of providing a nut in the slider 45 and a threaded hole in the mounting bed 46 respectively. The nut is adapted to secure to the threaded hole for achieving the same purpose described above in the other embodiments.

An ellipse drawing operation of the invention will be described in detailed below. A user may first position the center 13 by holding the post 12 with one hand prior to rotating the handle with the other hand so as to cause the gear assembly 20, the link assembly 30, and the drawing assembly 40 to turn with the post 12 about the center 13 in an operation of drawing a closed line. In detail, the first bevel gear 11 turns with the post 12 about the center 13 in response to rotating the handle. And in turn, the second bevel gear 21, the gearwheel 22, and the wheel 23 rotate. Also, the first joint 311, for example, clockwise rotates (see FIG. 8). Thus, the second joint 321 moves up and down repeatedly by transforming the rotational movement of the first link 31 into a vertical movement of the second link 32 as the user continuing the handle rotation, i.e., the second link 32 also moves up and down repeatedly. A lower end of the second link 32 is prevented from clearing the socket 42 in the operation. Moreover, the slider 45 slides relative to the groove 43. In one example, the slider 45 moves from a position proximate one end of the groove 43 to a position proximate the other end of the groove 43 in the ellipse drawing operation (see FIGS. 3 to 6).

It is understood that a distance from the mounting bed 46 to one end of the center 13 can be changed by adjusting a fastening position of the mounting bed 46 in the trough 451. It is found that the shorter of the distance the smaller of the drawn ellipse will be (see FIG. 7).

It is also understood that an elongate ellipse or an ellipse having a shape similar to a circle can be drawn by fastening the first joint 311 in a hole 232 other than the hole 232 as shown.

It is further understood that the drawing instrument of the invention can draw arcs.

Figure 9:
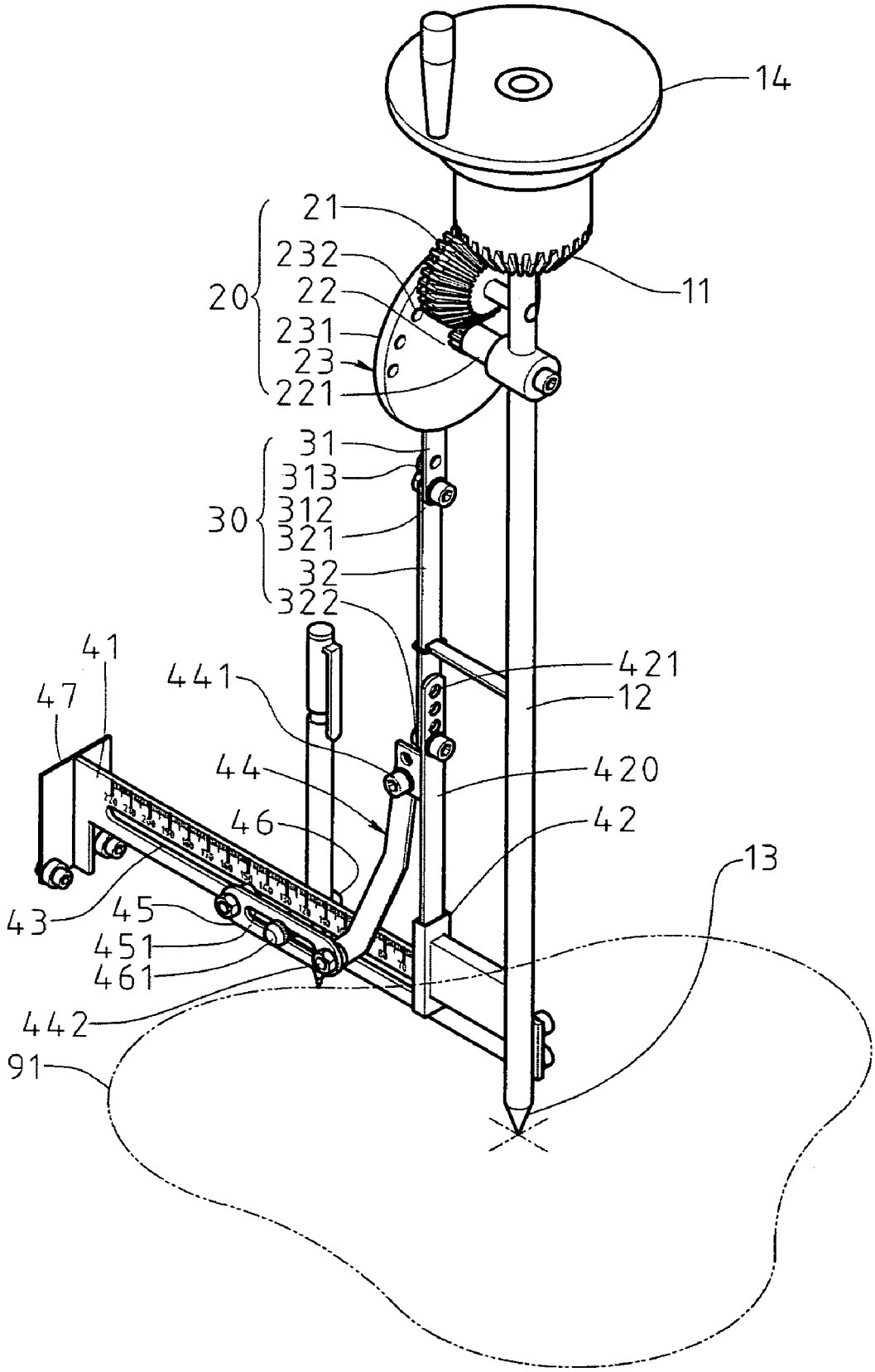
FIG. 9 is a perspective view of the instrument showing a closed line having three arcuate portions being drawn.
Figure 10:
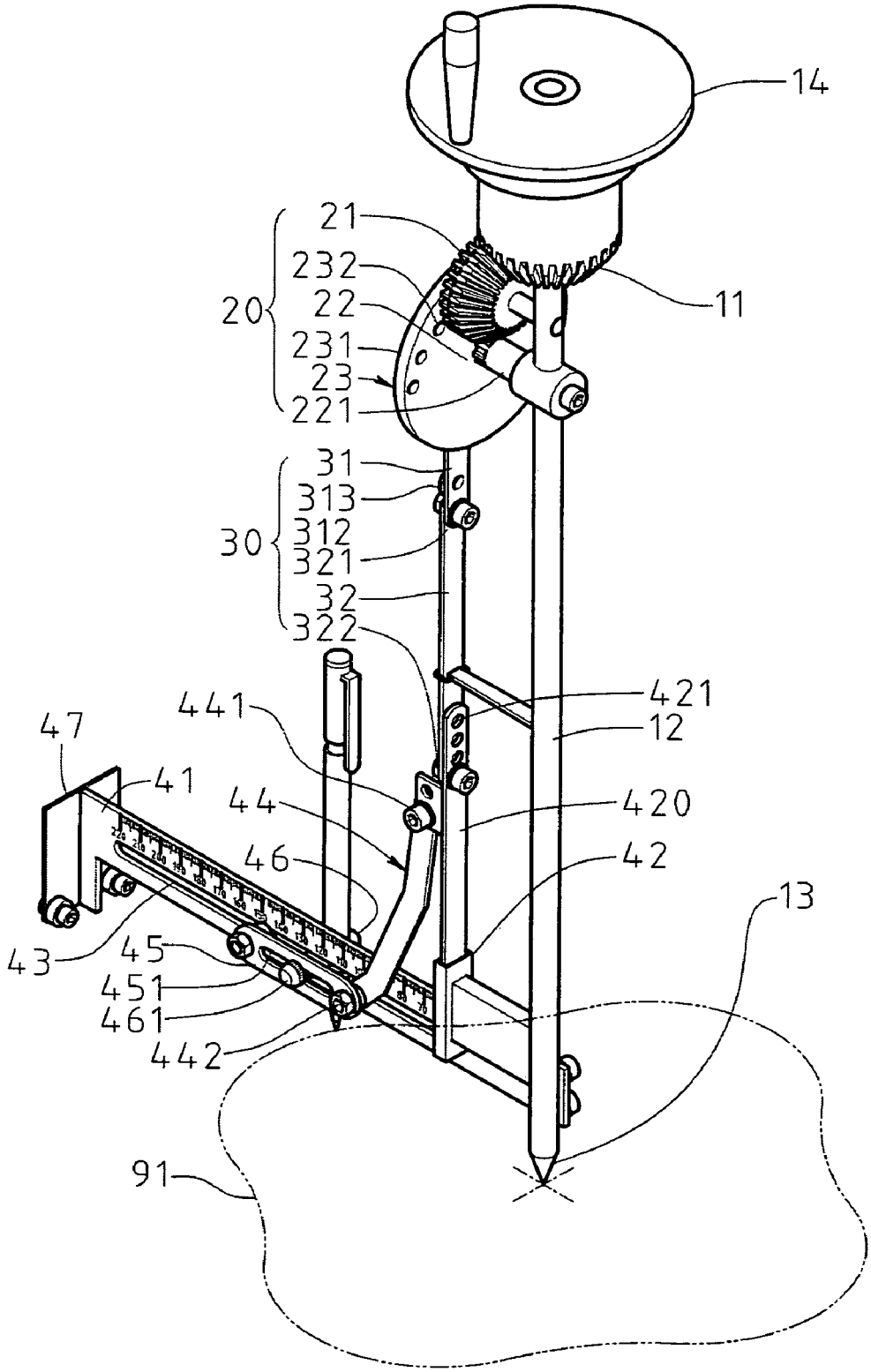
FIG. 10 is a perspective view of the instrument showing a closed line having four arcuate portions being drawn.

Referring to FIGS. 9 and 10, it is contemplated by the invention that one of a plurality of different closed lines can be drawn by the drawing instrument of the invention by adjusting a gear ratio of the second bevel gear 21 to the gearwheel 22. For example, a closed line 91 having three arcuate portions (i.e. lobes) can be drawn when the gear ratio is three (see FIG. 9), a closed line 91 having four arcuate portions can be drawn when the gear ratio is four (see FIG. 10), or a shape like a flower having a plurality of petals (i.e. lobes) can be drawn when the gear ratio is more than four, i.e., the higher of the gear ratio the higher the number of drawn petals (i.e., arcuate portions) will be. In the earlier examples, of a circle having one lobe, and an ellipse having two lobes, the gear ratio would be one, and two, respectively.

While the invention herein disclosed has been described by means of specific embodiments, numerous modifications and variations could be made thereto by those skilled in the art without departing from the scope and spirit of the invention set forth in the claims.

What is claimed is:

1. A compass comprising:

an upright turning assembly including a top disc, a rotatable handle extending from the disc, a cylindrical post, an upper first bevel gear extending downward from the disc and adapted to rotate about an upper portion of the post, a pointed center at a bottom end of the post, a bar extending from a first position of the post proximate the center, and a socket at an open end of the bar;

a gear assembly including a second bevel gear meshed with the first bevel gear, the second bevel gear including, a shaft having one end connected to and adapted to rotate about a second position of the post below the first bevel gear, a gearwheel meshed with the second bevel gear and having a shaft having one end inserted through a third position of the post below the second position and adapted to rotate about the third position of the post, and a wheel secured to the other end the shaft of the gearwheel and including a plurality of holes arranged as an arc;

a link assembly including a first link having an upper end pivotably secured to one of the holes, and a second link including an upper first section having an upper end pivotably secured to a lower end of the first link, and a lower second section adjustably secured to the first section and moveably received in the socket; and a drawing assembly including a horizontal arm having one end secured to a lower portion of the post, the arm including a scale and a lengthwise groove, a wheeled support at the other end of the arm, a third link having an upper end pivotably adjustably secured to the second section, and a lower end pivotably slidably fastened in the groove, a slider having one end secured to the lower end of the third link and the other end slidably fastened in the groove, the slider including a lengthwise trough, and a pen mounting bed including a fastener for adjustably securing the pen mounting bed to the groove and the trough;

whereby positioning the center and continuously rotating the handle in a first predetermined direction will turn the first bevel gear, causing the second bevel gear, the gearwheel, the wheel to rotate, causing the upper end of the first link to move the second link up and down repeatedly and repeatedly slide the slider back and forth with the pen mounting bed traveling around the center until an arcuate shape is drawn.

2. The compass of claim 1, wherein a radial distance traveled by the pen mounting bed is substantially defined by the length of the trough.

* * * * *